US008759723B2

(12) United States Patent
Nelson et al.

(10) Patent No.: US 8,759,723 B2
(45) Date of Patent: Jun. 24, 2014

(54) SYSTEM AND METHOD FOR LOW VOLTAGE DETECTION FOR HEAT PUMP WATER HEATERS

(75) Inventors: Jonathan Nelson, Louisville, KY (US); Craig Iung-Pei Tsai, Louisville, KY (US); Almir Begovich, Louisville, KY (US)

(73) Assignee: General Electric Company, Schenectady, NY (US)

( * ) Notice: Subject to any disclaimer, the term of this patent is extended or adjusted under 35 U.S.C. 154(b) by 399 days.

(21) Appl. No.: 13/214,456

(22) Filed: Aug. 22, 2011

(65) Prior Publication Data

US 2013/0047640 A1 Feb. 28, 2013

(51) Int. Cl.
*H05B 1/02* (2006.01)

(52) U.S. Cl.
USPC ..... 219/482; 219/481; 219/497

(58) Field of Classification Search
CPC ..... H05B 1/0202; H05B 1/269; H05B 6/06
USPC ..... 219/481–487, 494, 497, 506, 628, 660, 219/663, 664; 392/441, 449, 451, 456
See application file for complete search history.

(56) References Cited

U.S. PATENT DOCUMENTS

| | | | | |
|---|---|---|---|---|
| 5,523,550 | A * | 6/1996 | Kimura | 219/772 |
| 6,080,973 | A * | 6/2000 | Thweatt, Jr. | 219/497 |
| 6,430,949 | B2 | 8/2002 | Noro et al. | |
| 7,256,372 | B2 | 8/2007 | Knoeppel et al. | |
| 8,258,761 | B2 * | 9/2012 | Hammerstrom | 323/207 |
| 8,327,942 | B2 * | 12/2012 | Grimseth et al. | 166/368 |
| 2010/0206869 | A1 | 8/2010 | Nelson et al. | |
| 2010/0209084 | A1 | 8/2010 | Nelson et al. | |
| 2010/0217451 | A1 * | 8/2010 | Kouda et al. | 700/291 |
| 2012/0221150 | A1 * | 8/2012 | Arensmeier | 700/276 |
| 2013/0014830 | A1 * | 1/2013 | Goodson | 137/78.4 |
| 2013/0146586 | A1 * | 6/2013 | Harbin et al. | 219/494 |
| 2013/0180266 | A1 * | 7/2013 | Bois | 62/56 |

* cited by examiner

*Primary Examiner* — Mark Paschall
(74) *Attorney, Agent, or Firm* — Dority & Manning, P.A.

(57) ABSTRACT

Systems and methods for low voltage detection for a heat pump water heater are disclosed. A current sensor can be used to monitor current supplied to a inductive load, such as a compressor or evaporator fan, of the heat pump water heater. The current sensor can be coupled to a controller which receives and processes information from the current sensor to determine whether a low voltage condition of the heat pump water heater has occurred. An alert can be provided to an installer/user of the heat pump water heater that a low voltage condition has occurred. The controller can also disconnect the heat pump water heater from the power source to prevent damage to the heat pump water heater.

18 Claims, 2 Drawing Sheets

SYSTEM AND METHOD FOR LOW VOLTAGE DETECTION FOR HEAT PUMP WATER HEATERS

FIELD OF THE INVENTION

The present disclosure relates to water heaters, and more specifically to low voltage condition detection for heat pump water heaters.

BACKGROUND OF THE INVENTION

A widely used water heater for commercial and residential hot water production and storage is the electric resistance water heater. The electric resistance water heater typically includes a storage tank for retaining water and one or more electric resistance heating elements that heat the water in the storage tank.

Typical electric resistance water heaters are supplied with about 240V AC power. However, in certain circumstances a low voltage condition may occur where the water heater becomes connected to a lower voltage power source. For instance, the electric resistance water heater may be improperly miswired to a 120V AC source. Alternatively, a switching device used by the utility company or consumer to reduce peak load or to reduce power during high electric rate periods may reduce voltage from 240V AC to 120V AC. In addition, a brown-out may cause the voltage in a given area to sag to unacceptable levels for long periods of time.

The electric resistance heating elements used in electric resistance water heaters are intended for use at about 240V AC, but if a low voltage condition occurs, the electric resistance heating elements will still operate, just at reduced power. The electric resistance heating elements are not typically damaged by operating at lower voltages, such as at about 120V AC.

Recently, the heat pump water heater has been used as an alternative or in addition to electric resistance water heaters. A low voltage condition is more problematic for the heat pump water heater. The heat pump water heater includes various inductive loads, such as a motor-driven compressor and one or more evaporator fans, that are sensitive to voltage. In particular, as the voltage supply to the inductive load decreases, the current increases. For instance, if a compressor draws 3 A at 240V, it will draw 6 A at 120V. The higher current can lead to overheating of the motor windings, and potentially may cause the compressor or other inductive load to fail. Additionally, any electrical components in line with or sharing a common connection with the compressor or other inductive load may be damaged if the electrical components are not rated for the higher current caused by the low voltage condition. The resulting damage may require the heat pump water heater to be repaired or replaced, costing either the consumer or manufacturer a significant amount.

Thus, a need exists for a system and method that can detect a low voltage condition for a heat pump water heater. A system and method that can provide notification of the low voltage condition to an installer/user and protects the components of the heat pump water heater, such as the compressor, evaporator fans and other electrical components, from damage would be particularly useful.

BRIEF DESCRIPTION OF THE INVENTION

Aspects and advantages of the invention will be set forth in part in the following description, or may be obvious from the description, or may be learned through practice of the invention.

One exemplary embodiment of the present disclosure is directed to a method for low voltage detection of a heat pump water heater. The heat pump water heater includes a heat pump system having one or more inductive loads. The method includes monitoring a current level supplied from a power source to an inductive load of the heat pump water heater and determining that a low voltage condition of the heat pump water heater has occurred based at least in part on the current level supplied from the power source to the inductive load.

Another exemplary embodiment of the present disclosure is directed to a system for low voltage detection of a heat pump water heater. The heat pump water heater includes a heat pump system having one or more inductive loads. The system includes a sensing device configured to monitor the current level supplied from a power source to the inductive load of the heat pump water heater. The sensing device provides an output signal associated with the current level supplied to the inductive load. The system further includes a controller coupled to the sensing device such that the controller receives the output signal. The controller is configured to determine that a low voltage condition of the heat pump water heater has occurred based at least in part on the current level associated with the output signal.

A further exemplary embodiment of the present disclosure is directed to a heat pump water heater. The heat pump water heater includes a storage tank and a heat pump system. The heat pump system includes a compressor, an evaporator, a condenser, and a heat transfer medium configured to flow from compressor to condenser to evaporator and back to compressor, the condenser being positioned in heat exchange relationship with the storage tank. The water heater further includes a sensor configured to monitor the current supplied from a power source to the compressor. The water heater further includes a controller operably connected to the sensor. The controller is configured to receive and process data from the sensor associated with the current supplied from the power source to the compressor. The controller is further configured to compare the current to a threshold value and, if the current exceeds the threshold value, to determine that a low voltage condition of the heat pump water heater has occurred.

Variations and modifications can be made to these exemplary embodiments of the present disclosure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
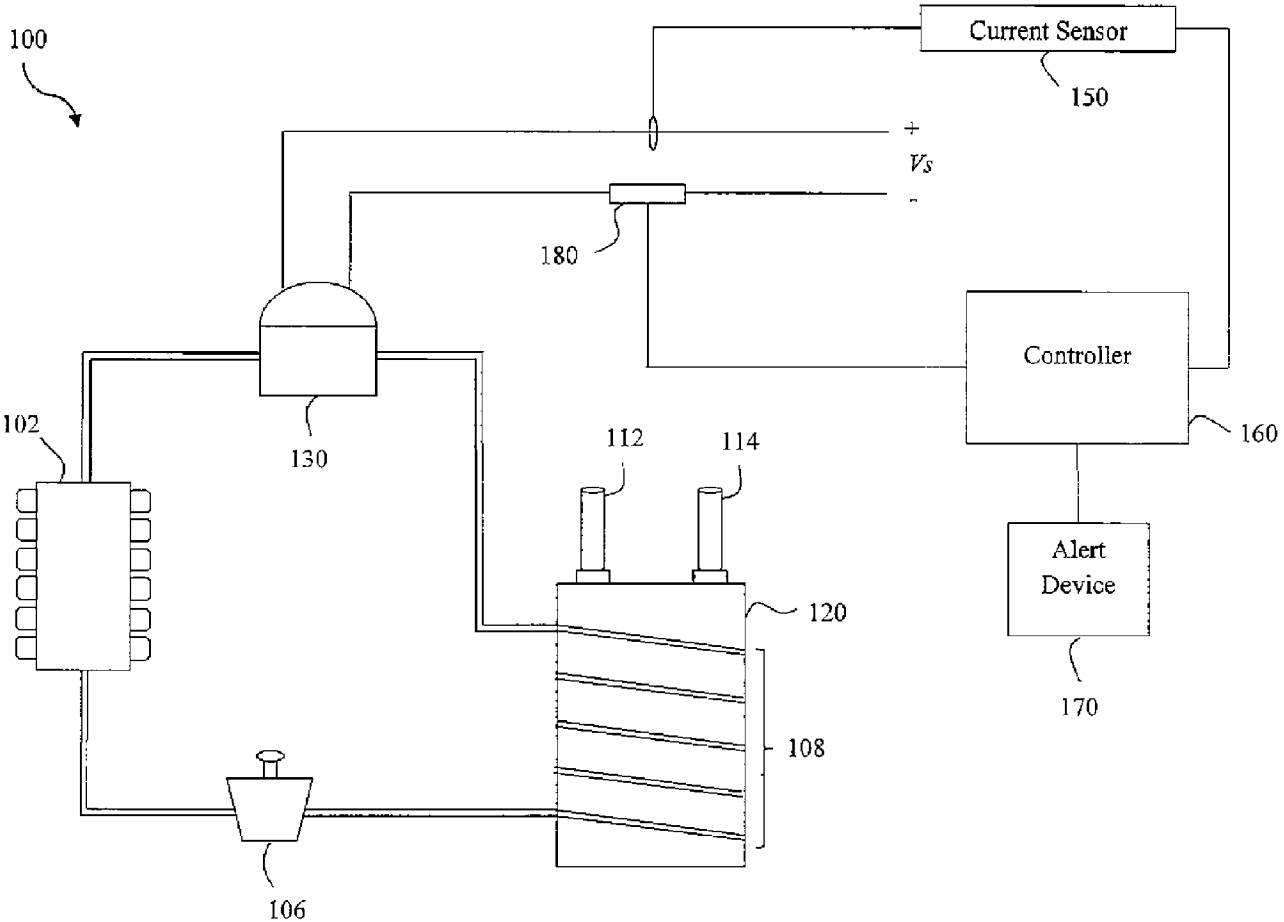
FIG. 1 depicts an exemplary heat pump water heater system according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure is directed to a system and method for low voltage detection of a heat pump water heater. The system and method of the present disclosure monitor the current flowing to an inductive load of the heat pump water heater, such as a compressor or an evaporator fan, and determine whether a low voltage condition has occurred based at least in part on the current flowing to the inductive load. For example, in a particular embodiment, the current flowing to the inductive load can be compared to a threshold value. If the current exceeds the threshold value, then a controller determines that a low voltage condition has occurred. The controller can then disconnect the power to the heat pump water heater and provide an alert to a user/installer to repair the connection.

The system and method of the present disclosure can be used to detect any low voltage condition of the heat pump water heater or component of the heat pump water heater. A low voltage condition can occur anytime the voltage supplied to the heat pump water heater or component of the heat pump water heater falls below a threshold. For instance, a low voltage condition can occur when the voltage supplied to the heat pump water heater falls outside a threshold percentage range of the rated or operating voltage of the heat pump water, such as outside within about 10% to about 15% of 240V AC or outside within about 10% to about 15% of 208V AC.

A common low voltage condition occurs by miswiring the compressor or other component of the heat pump water heater. Improper wiring or miswiring of compressor can easily occur by simply connecting the wrong power wires to compressor. For instance, an installer/user can couple the compressor or other system components to a +120V power wire and neutral wire instead of to a +120V power wire and −120V power wire. This results in the source voltage of about 120V AC being supplied to compressor as opposed to the required 240V AC. Improper wiring of compressor to a 120V AC power source will draw higher current, leading to overheating of the compressor and possible damage to compressor and other system components.

Referring now to the figures, FIG. 1 depicts a heat pump water heater system 100 according to an exemplary embodiment of the present disclosure. The heat pump water heater system 100 includes an evaporator 102, a compressor 130, a condenser 108, and a throttling device 106. The heat pump water heater system 100 may include one or more fans proximate the evaporator 102. Condenser 108 is arranged in a heat exchange relationship with water storage tank 120. During operation of the heat pump cycle, a heat transfer medium, such as refrigerant, exits the evaporator 102 as a fluid in the form of a superheated vapor and/or high quality vapor mixture. Upon exiting the evaporator 102 the refrigerant enters the compressor 130 where the pressure and temperature increase. The temperature and pressure are increased in the compressor 130 such that the refrigerant becomes a superheated vapor. The superheated vapor from the compressor 130 enters the condenser 108. While in the condenser 108, the superheated vapor transfers energy to the water within a storage tank 120. Upon transferring energy to the water within the storage tank 120, the refrigerant turns into a saturated liquid and/or high quality liquid vapor mixture. This high quality/saturated liquid vapor mixture exits the condenser 108 and travels through the throttling device 106. Upon exiting the throttling device 106 the pressure and temperature of the refrigerant drop at which time the refrigerant enters evaporator 102 and the cycle repeats itself.

The heat pump water heater 100 includes a water inlet line 112 for allowing cold water to enter the heat pump water heater 100, where it can directed to the bottom of the tank 120 via a dip tube. The heated water exits the storage tank 120 through exit 114 and flows to the residence or other place where heated water is desired. The heat pump water heater system 100 can include various sensors placed to sense the temperature of the water in the tank as well as other temperatures, such as heat pump condenser inlet and outlet temperatures, ambient temperature, etc.

As shown in FIG. 1, compressor 130 (as well as other components of the heat pump water heater system 100 such as AC powered fans) can be coupled to a power source that provides a source voltage Vs to the compressor 130 and various other components of the heat pump water system 100. Typical standard power source connections for residential water heater systems include either about 240V AC or about 120V AC. Other connections can include about 208V AC. Most typical compressors for heat pump water heater systems are rated for operation at about 240V AC.

To detect whether a low voltage condition has occurred, the system 100 includes a current sensor 150 and a controller 160. Current sensor 150 can be used to monitor the current flowing through one of the power wires coupled to compressor 130 or other inductive load. Current sensor 150 can be any device that can provide an output signal associated with the current flowing to compressor 130 or other inductive load. For instance, in a particular embodiment, current sensor 150 is a toroid style current transducer. Alternatively, the current sensor 150 can monitor the current flowing to compressor 130 or other inductive load by various other methods, such as by monitoring voltage level, monitoring the presence of voltage, or even monitoring the temperature of a component that heats/cools depending on the level of current flowing to the compressor 130.

The current sensor 150 provides an output signal associated with the current level flowing to compressor 130 or other inductive load to controller 160. Controller 160 can include a microprocessor and a memory programmed to determine that a low voltage condition, such as one caused by a miswire, has occurred based at least in part on the output signal associated with the current level received from the current sensor 150. For example, controller 160 can compare the current level measured by the current sensor 150 to a threshold. If the current level exceeds the threshold, the controller 160 can determine that a low voltage condition has occurred.

As an example, the threshold value can be set at about 5.5 A. If the current level exceeds about 5.5 A, the controller 160 can determine that the compressor 130 has been miswired to a 120V power source or that the voltage has dropped below 177V (a value outside the range of about 10% to 15% of 208V AC). If the current level is in the range of about 1.5 A to about 5.5 A, the controller 160 can determine that the compressor 130 is wired properly to a power source. Those of ordinary skill in the art, using the disclosures provided herein, should understand that the value of the threshold is unique to the compressor being used and can be modified to suit a particular application without deviating from the scope or spirit of the present invention.

Once the controller 160 has determined that a low voltage condition has occurred, the controller 160 can provide an alert to the installer/user through alert device 170. Alert device 170 can be configured to provide any type of alert, such as an audible alert, visual alert, vibratory alert, or other suitable alert. The controller 160 can also be configured to disconnect the compressor 130 or other inductive load from the power source to prevent damage to compressor 130 or other inductive load and other components. For instance, controller 160 can be coupled to a switching device 180 that can be used to disconnect power from compressor 130 or other inductive load in the event of a low voltage condition. In this manner, components of the water heater system 100 can be protected in the event of a low voltage condition.

The low voltage detection routine performed by controller 160 can be performed during startup of the heat pump water heater system 100 such that any time power is connected or reconnected to a component of the heat pump water heater system 100, controller 160 will determine if a low voltage condition has occurred. In one embodiment, the controller 160 can determine whether a low voltage condition has occurred, such as by comparing the current level supplied to compressor 130 or other inductive load to a threshold, only after a predetermined period of time has passed after startup of the heat pump water heater system 100. This allows time for in-rush current to subside and for the compressor 130 or other inductive load to be running in stable condition. In a particular implementation, the predetermined period of time can be about 5 seconds or more.

Figure 2:
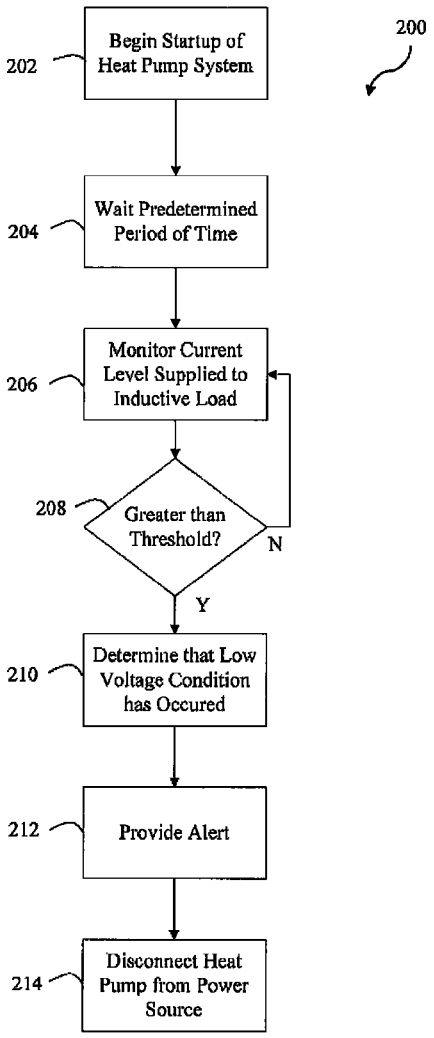
FIG. 2 provides a flow diagram of an exemplary method according to an exemplary embodiment of the present disclosure.

With reference to FIG. 2 an exemplary method 200 for low voltage detection of a heat pump water heater will now be disclosed. At 202, the method 200 begins startup of the heat pump water heater. Startup of the heat pump water heater can be initiated by providing power to the compressor and/or other components of the heat pump water heater. At 204, the method 200 waits a predetermined period of time, such as about 5 seconds, to allow the in-rush current to the compressor or other inductive load to subside and to allow the compressor to be in steady state operation.

At 206, the method 200 monitors the current level supplied to the compressor or other inductive load of the heat pump water heater. The current level can be monitored using a current sensor or any other device suitable for monitoring the current supplied to the compressor or other inductive load. For instance, in a particular embodiment, the current level can be monitored using a toroid style current transducer.

At 208, the method 200 compares, for instance through a controller, the current level to a threshold. As discussed above, a compressor or other inductive load of a heat pump water heater will draw more current if it is improperly wired to a 120V power source as opposed to a 240V power source. Accordingly, if the current exceeds the threshold, the method 200 can determine that a low-voltage condition has occurred as shown at 210. If the current level is not greater than the threshold, the method 200 can continue to monitor the current level to determine whether the current level ever exceeds the threshold.

As an example, the method 200 can determine that the heat pump water heater is improperly connected to a 120V source if the current is greater than about 5.5 A or more. The method 200 can determine that the heat pump water heater is properly connected to a 240V source if the current is in the range of about 1.5 A to about 5.5 A. Those of ordinary skill in the art, using the disclosures provided herein, should understand that the value of the threshold is unique to the compressor being used and can be modified to suit a particular application without deviating from the scope or spirit of the present invention.

At 212 after it has been determined that a low voltage condition has occurred, the method 200 can provide an alert to an installer/user through an alert device. The alert can be any suitable alert for notifying an installer/user that a low voltage condition has occurred. At 214, the method 200 can also disconnect the heat pump water heater from the power source to prevent damage to the compressor and/or other components of the heat pump water heater.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for low voltage detection of a heat pump water heater, the heat pump water heater comprising a heat pump system having one or more inductive loads, the method comprising:

monitoring a current level supplied from a power source to the inductive load; and determining that a low voltage condition of the heat pump water heater has occurred based at least in part on the current level supplied from the power source to the inductive load;

wherein determining that a low voltage condition of the heat pump water heater has occurred comprises:

determining that the heat pump water heater is coupled to a first power source having a first voltage level when the current level is less than a threshold current; and determining that the heat pump water heater is coupled to a second power source having a second voltage level when the current is greater than the threshold current, the first voltage level being greater than the second voltage level.

2. The method of claim 1, the method further comprising providing an alert that a low voltage condition has occurred.

3. The method of claim 1, the method further comprising disconnecting the inductive load from the power source after determining that a low voltage condition has occurred.

4. The method of claim 1, wherein the inductive load comprises a compressor or an evaporator fan of the heat pump system.

5. The method of claim 1, wherein determining that a low voltage condition of the heat pump water heater has occurred comprises:

determining that the heat pump water heater is coupled to a power source having a voltage in the range of about 177V AC to 280V AC if the current level is in the range of about 1.5 A to about 5.5 A; and determining that the heat pump water heater is coupled to a power source of less than about 177V AC if the current level is greater than about 5.5 A.

6. The method of claim 1, wherein the method is performed during startup of the heat pump system anytime a power supply is connected or reconnected to the heat pump water heater.

7. The method of claim 6, the method comprising comparing the current level to a threshold value only after a predetermined period of time has passed after startup of the heat pump system.

8. The method of claim 7, wherein the predetermined period of time is about 5 seconds or more.

9. A system for low voltage detection of a heat pump water heater, the heat pump water heater comprising a heat pump system having one or more inductive loads, the system comprising:

a sensing device configured to monitor the current level supplied from a power source to the inductive load of the heat pump water heater, said sensing device providing an output signal associated with the current level supplied to the inductive load; and a controller coupled to said sensing device such that said controller receives the output signal, said controller configured to determine that a low voltage condition of the heat pump water heater has occurred based at least in part on the current level associated with the output signal;

wherein the controller is further configured to determine that the heat pump water heater is coupled to a first power source having a first voltage level when the current level is less than a threshold current; and to determine that the heat pump water heater is coupled to a second power source having a second voltage level when the current is greater than the threshold current, the first voltage level being greater than the second voltage level.

10. The system of claim 9, wherein the inductive load comprises a compressor or an evaporator fan of the heat pump system.

11. The system of claim 9, wherein the system further comprises an alert device configured to provide an alert if the controller determines that a low voltage condition of the heat pump water heater has occurred.

12. The system of claim 9, wherein the controller is configured to disconnect the inductive load from the power source after determining that a low voltage condition of the heat pump water heater has occurred.

13. The system of claim 9, wherein the sensing device comprises a toroid style current transducer.

14. A heat pump water heater, comprising:

a storage tank;

a heat pump system having a compressor, an evaporator, a condenser, and a heat transfer medium configured to flow from compressor to condenser to evaporator and back to compressor, the condenser being positioned in heat exchange relationship with the storage tank;

a sensor configured to monitor the current supplied from a power source to the compressor; and, a controller operably connected to the sensor, the controller configured to receive and process data from the sensor associated with the current supplied from the power source to the compressor, the controller configured to compare the current to a threshold value and, if the current exceeds the threshold value, to determine that a low voltage condition of the heat pump water heater has occurred;

wherein the controller is further configured to determine that the heat pump water heater is coupled to a first power source having a first voltage level when the current level is less than a threshold current; and to determine that the heat pump water heater is coupled to a second power source having a second voltage level when the current is greater than the threshold current, the first voltage level being greater than the second voltage level.

15. The heat pump water heater of claim 14, wherein the heat pump further comprises an alert device configured to provide an alert if the controller determines that a low voltage condition of the heat pump water heater has occurred.

16. The heat pump water heater of claim 14, wherein the controller is further configured to disconnect the compressor from the power source after determining that a low voltage condition of the heat pump water heater has occurred.

17. The heat pump water heater of claim 14, wherein the sensor comprises a toroid style current transducer.

18. The heat pump water heater of claim 14, wherein the low voltage condition is a miswire of the heat pump water heater.

* * * * *